US010948205B2

(12) United States Patent
McGarva et al.

(10) Patent No.: US 10,948,205 B2
(45) Date of Patent: Mar. 16, 2021

(54) HUMIDIFICATION MODULE FOR AN AIR TREATMENT APPARATUS

(71) Applicant: KONINKLIJKE PHILIPS N.V., Eindhoven (NL)

(72) Inventors: John Robert McGarva, Eindhoven (NL); Bao Wang, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 103 days.

(21) Appl. No.: 15/760,651

(22) PCT Filed: May 26, 2017

(86) PCT No.: PCT/EP2017/062807
§ 371 (c)(1),
(2) Date: Mar. 16, 2018

(87) PCT Pub. No.: WO2017/203054
PCT Pub. Date: Nov. 30, 2017

(65) Prior Publication Data

US 2019/0137124 A1 May 9, 2019

(30) Foreign Application Priority Data

May 26, 2016 (WO) ..... PCT/CN2016/083486
Aug. 30, 2016 (EP) ..... 16186219

(51) Int. Cl.
*F24F 6/04* (2006.01)
*F24F 13/14* (2006.01)
(Continued)

(52) U.S. Cl.
CPC ..... *F24F 6/043* (2013.01); *F24F 3/1603* (2013.01); *F24F 6/04* (2013.01); *F24F 11/00* (2013.01);
(Continued)

(58) Field of Classification Search
None
See application file for complete search history.

(56) References Cited

U.S. PATENT DOCUMENTS 6,248,155 B1 6/2001 Seaman
9,303,923 B2 * 4/2016 Varma ..... F24F 5/0035
(Continued)

FOREIGN PATENT DOCUMENTS

CN 102748817 B 5/2014
EP 2072921 A1 6/2009
(Continued)

OTHER PUBLICATIONS http://image.haier.com/cn/gyzlk/sms/smskt/201504/P020150410371739228402.pdf.

*Primary Examiner* — Christopher P Jones
*Assistant Examiner* — Phillip Y Shao

(57) ABSTRACT

The present disclosure relates to an humidification attachment module (66) arranged to be coupled with an air treatment apparatus (10), the module comprising a fluid dispensing unit (88) for a humidification fluid that is supplied by a fluid reservoir (86), a flow inlet (74) for an inlet air flow (120), a first flow path defined between the flow inlet (74) and a first flow outlet (76), a second flow path defined between the flow inlet (74) and a second flow outlet (78), and a flow dividing unit (100), wherein the first flow path bypasses the fluid dispensing unit (88), wherein the second flow path passes through the fluid dispensing unit (88), and wherein the flow dividing unit (100) is operable to divide an overall flow through the humidification module into a first flow path component (122) and a second flow path component (124). The present disclosure further relates to air treatment apparatus (10) and to a method of augmenting an air treatment apparatus (10).

13 Claims, 6 Drawing Sheets

(51) Int. Cl.

| | |
|---|---|
| ***F24F 13/20*** | (2006.01) |
| ***F24F 13/28*** | (2006.01) |
| ***F24F 11/00*** | (2018.01) |
| ***F24F 13/02*** | (2006.01) |
| ***F24F 3/16*** | (2021.01) |

(52) U.S. Cl.

CPC ..... *F24F 13/0272* (2013.01); *F24F 13/14* (2013.01); *F24F 13/1413* (2013.01); *F24F 13/20* (2013.01); *F24F 13/28* (2013.01); *F24F 2221/36* (2013.01)

(56) References Cited

U.S. PATENT DOCUMENTS

| | | | | |
|---|---|---|---|---|
| 9,696,050 | B2 * | 7/2017 | McGarva ..... | F24F 6/043 |
| 2004/0178518 | A1 | 9/2004 | Keller | |
| 2007/0256433 | A1 | 11/2007 | Bhatti | |
| 2008/0193328 | A1 | 8/2008 | Crapser | |

FOREIGN PATENT DOCUMENTS

| | | | |
|---|---|---|---|
| EP | 2865957 | A1 | 4/2015 |
| EP | 3054227 | A1 | 8/2016 |
| KR | 20110008625 | A | 1/2011 |
| WO | 2016000413 | A1 | 1/2016 |

* cited by examiner

HUMIDIFICATION MODULE FOR AN AIR TREATMENT APPARATUS

This application is the U.S. National Phase application under 35 U.S.C. § 371 of International Application No. PCT/EP2017/062807 filed on May 26, 2017, which claims the benefit of International Application No. PCT/CN2016/083486 filed on May 26, 2016 and International Application No. 16186219.8 filed on Aug. 30, 2016. These applications are hereby incorporated by reference herein.

FIELD OF THE INVENTION

The present disclosure relates to air treatment apparatuses. More generally, the present invention relates to home appliances that are arranged for treatment of ambient air in buildings, so as to improve a sense of well-being of the present residents.

More particularly, the disclosure relates to augmented air treatment apparatuses that involve a humidification feature, in addition to other air treatment features, e.g. an air purifying feature.

BACKGROUND OF THE INVENTION

U.S. Pat. No. 6,248,155 B1 discloses a humidifier/air purifier comprising a housing defining a water reservoir, an air inlet opening and an air outlet opening; a generally V-shaped wicking element in fluid communication with said reservoir; a generally V-shaped air filter being removably mounted above and within said wicking element; and a blower for causing air flow through said air inlet opening, through said wicking element, through said air filter and through said air outlet opening.

Air treatment apparatuses may be used in housing areas, but also in working areas, including offices, workshops, shops, etc. So-called single-purpose air purifying apparatuses are available on the market. An air purifying apparatus is a device which is arranged to remove small particles and contaminants from the ambient air in a room. These devices are commonly considered as being beneficial to allergy sufferers and asthmatics, and at reducing or eliminating second-hand tobacco smoke. Further field of application may be envisaged.

Those appliances may be regarded as domestic appliances that improve the quality of the room air in buildings. Air purifying apparatuses may utilize, for instance, a set of filters to clean the room air. Further, air quality sensors may be provided. A ventilating unit may be provided that generates an air flow through the appliances.

However, it has been observed that the air purifying feature may be improved when the air that flows through the apparatus is not only purified but also humidified. In this context so-called combined air purifying and humidification apparatuses have been proposed. However, it also has been observed that those combined appliances often compromise at least one of the purifying feature and the humidifying feature. Further, stand-alone humidifying apparatuses are known. However, generally, those devices are not arranged to be operatively coupled with a separate purifying apparatus.

SUMMARY OF THE INVENTION

It is an object of the present disclosure to provide an augmented air treatment apparatus and a humidification module that is arranged for augmenting an air treatment apparatus. Preferably, the humidification module enhances an air cleaning capability of the apparatus. Further, it is desirable to provide a humidification module that may be manufactured and assembled with considerably little effort.

There is a certain need for a humidification module that is arranged for upgrading stand-alone air purifying apparatuses. Preferably, the module is arranged as an attachment module and adapted to an existing shape and function of a present air purifying apparatus. More preferably, the humidification module allows for a control of an air flow through the module which involves a control of a degree of humidification.

In a first aspect of the present disclosure there is provided an air treatment apparatus comprising:

- a ventilating unit that generates an air flow through the apparatus;
- an air purification module for purifying air;
- a main housing having a flow outlet for the purified air;
- a humidification attachment module having a flow inlet for said purified air, and a housing portion having a first flow outlet; and
- an outlet grille (20) for covering one of the flow outlet (46) and the first flow outlet (76), wherein the humidification attachment module (66) and the outlet grille (20) interchangeably cover the flow outlet (46) such that the apparatus (10) is configurable to adopt both an augmented configuration in which the humidification attachment module (66) covers the flow outlet (46) in lieu of the outlet grille (20), with the outlet grille (20) covering the first flow outlet (76), and a non-augmented configuration in which the outlet grille (20) covers the flow outlet (46).

The humidification attachment module may comprise:

- a fluid dispensing unit for a humidification fluid that is supplied by a fluid reservoir,
- the flow inlet for an inlet air flow,
- a first flow path defined between the flow inlet and the first flow outlet,
- a second flow path defined between the flow inlet and a second flow outlet, and
- a flow dividing unit, wherein the first flow path bypasses the fluid dispensing unit, wherein the second flow path passes through the fluid dispensing unit, and wherein the flow dividing unit is operable to divide an overall flow through the humidification module into a first flow path component and a second flow path component. The fluid reservoir may also be part of the humidification attachment module. The outlet grille may be fixed to the main housing such that the outlet grille covers the flow outlet. This may be achieved by a complementary connection, e.g. a male-female joint, between a first fixing member on the outlet grille and a second fixing member associated with the flow outlet of the main housing. The housing portion of the humidification attachment module may have a further first fixing member associated with the flow inlet which complements the second fixing member such that the humidification attachment module can be attached to the main housing, i.e. when the augmented configuration is adopted. The housing portion may have a further second fixing member which is associated with the first flow outlet which may complement the first fixing member such that the outlet grille can be attached to the housing portion so as to cover the first flow outlet.

This embodiment is based on the insight that the humidification module may provide two flow paths one of which may be regarded as a humidification flow path while the other one may be regarded as a dry flow path or non-humidified flow path. Due to the provision of the flow dividing unit, a ratio of humidified air and dry air in the overall outlet air flow may be easily controlled. Consequently, the operational performance and controllability of the humidification module is greatly improved. By providing two flow paths one of which cooperates with the fluid dispensing unit while the other one does not cooperate with the fluid dispensing unit, a simple mechanism is provided for adjusting the overall humidification. Similar to a water tap that is arranged to mix cold water and hot water, the resulting degree of humidity may be basically freely selected within a considerably broad range by mixing a humidified and a non-humidified flow component.

The humidification module as such does not require a ventilating unit. Rather, the humidification module is arranged to utilize the outlet flow of the air treatment apparatus that is supplied by the ventilating unit thereof.

Preferably, the fluid dispensing unit comprises two sections that are arranged in a fashion opposite to one another at opposite walls of the housing portion. For instance, two fluid dispensing pads may be provided. Further, the second flow path that passes the fluid dispensing unit and that may entrain a humidification fluid therefrom may be split into two parts. For instance, the first flow path that bypasses the fluid dispensing unit may be a central flow path that flows through the module in an upward direction. The first flow path may be arranged between the two split components of the second flow path. The components of the second flow path may escape from the humidification module through opposite lateral walls.

The first flow may be generally referred to as dry or non-humidified flow. The second flow may be generally referred to as humidified flow. The air treatment apparatus may be primarily arranged as an air purifying apparatus.

Both the first flow path component and the second flow path component jointly define the overall flow through the humidification attachment module. Each flow component may theoretically amount to a share of 0% up to 100% of the overall flow. In practice, there may be embodiments where none of the flow components may be totally blocked.

In an exemplary embodiment of the attachment module, the fluid dispensing unit comprises absorbing material arranged for storing the humidification fluid that is provided by the fluid reservoir and entrained by the passing air flow.

The absorbing material may be referred to as wick material, sponge material, fabric material, tissue material, etc. The purpose of the absorbing material is to temporarily store fluid (typically water) and to provide the fluid for entrainment by the passing air flow which is in this way humidified.

In an exemplary embodiment of the attachment module, the absorbing material comprises wick material that forms at least one wick pad that is arranged to be impregnated with the humidification fluid. The wick material may temporarily store and gradually dispense the humidification fluid.

In an exemplary embodiment of the attachment module, the wick material is associated with the second flow outlet. Preferably, two opposite wick pads are provided which are arranged on opposite lateral sides of the humidification module that jointly form the second flow outlet.

In an exemplary embodiment of the attachment module, the fluid dispensing unit comprises at least two sections that are spaced away from one another, wherein the first flow outlet is arranged in such a way that the first flow path is led through an intermediate passage space between the at least two sections of the fluid dispensing unit toward the first flow outlet.

Consequently, even though only limited installation space is provided, considerably large flow cross sections for the first flow path and the second flow path are provided. Needless to say, each of the at least two sections of the fluid dispensing unit may be provided with a respective absorbing material, particularly a wick pad.

In an exemplary embodiment of the attachment module, the flow dividing unit comprises at least one adjustable flow diverter that is operable to adjust a ratio between the first flow path component and a second flow path component. As used herein, the flow diverter may be controlled to selectively prevent or permit a certain flow path. This may be accomplished by respectively blocking or releasing the cross section of the flow path.

In an exemplary embodiment of the attachment module, the at least one adjustable flow diverter is arranged as a movable louver, wherein the at least one adjustable flow diverter is arranged to be pivoted about a swivel axis, thereby diverting the inlet air flow depending on an actual swivel state.

In other words, the flow diverters may be arranged as shutters. In certain embodiments, the flow diverters may be manually actuated. In certain embodiments, the flow diverters may be motor powered. For instance, step-motors may be envisaged for powering the flow diverters. In certain embodiments, two flow diverters are provided. In certain embodiments, the two flow diverters are arranged to be actuated in synchronism.

In an exemplary embodiment of the attachment module, a pair of opposite louvers is provided each of which is associated with a section of the fluid dispensing unit, wherein the opposite louvers inhibit the first flow path component of the overall flow in a second swivel state, and wherein the opposite louvers inhibit the second flow path component of the overall flow in a first swivel state.

Preferably, the two louvers are arranged to jointly block the first flow outlet in the second swivel state, wherein, in the first swivel state, each of the two louvers blocks a respective section of the (split or distributed) second flow outlet.

When the louvers inhibit a certain flow component, then the share of the other component of the flow is enhanced. The opposite louvers, depending on their actual swivel state, at least partially block one of the flow paths. Further, as the louvers are associated with the flow inlet of the humidification attachment module, the inlet flow may be diverted and/or deflected by the louvers so as to preferably maintain an overall flow rate.

In an exemplary embodiment of the attachment module, the fluid reservoir comprises a water compartment that defines a bypass opening for the first flow path component, and wherein the fluid reservoir comprises guiding surfaces for guiding the second flow path component towards the second flow outlet.

Preferably, the water compartment encloses the bypass opening. Hence, the water compartment forms a frame extending around the bypass opening. Consequently, also the fluid reservoir is arranged for flow guiding. Preferably, the fluid reservoir comprises at least one inclined lateral guide surface for deflecting the second flow component, and to guide the second flow component towards the second flow outlet.

In an exemplary embodiment, the attachment module further comprises an indicator extension which is arranged to operate a status switch on the main housing when the attachment module is attached thereto, wherein the status switch disables an operation of the attachment module when the outlet grille is removed, i.e. from the housing portion.

The status switch may be also referred to as safety switch. The status switch may be arranged as a Reed switch. Consequently, an indicator for the status switch may be a permanent magnet that is attached to or operatively coupled with the covering grille. In accordance with this embodiment, the status switch is arranged to detect the presence or the indicator.

In an exemplary embodiment, the attachment module is arranged to be attached to the air treatment apparatus in a snap-on mounting fashion. Preferably, the attachment module is arranged to be attached to the air treatment apparatus in a top mounting fashion. In other words, the attachment module forms a top extension of an overall shape of the air treatment apparatus. Further, the attachment module may be adapted to an interface of the air treatment apparatus that is originally provided for the outlet grille thereof.

In a further aspect of the present disclosure there is provided an air treatment apparatus, the apparatus comprising:

a main housing, a ventilating unit that generates an air flow through the apparatus, an air purification module, and an air humidification module, the module comprising:

a fluid reservoir for a humidification fluid, a fluid dispensing unit that is supplied by or coupled to the fluid reservoir, a flow inlet for an inlet air flow of purified air supplied from the air purification module, a first flow path defined between the flow inlet and a first flow outlet, a second flow path defined between the flow inlet and a second flow outlet, and a flow dividing unit, wherein the first flow path bypasses the fluid dispensing unit, wherein the second flow path passes through the fluid dispensing unit, and wherein the flow dividing unit is operable to divide an overall flow through the humidification module into a first flow path component and a second flow path component.

In accordance with this aspect, a combined air purifying and humidifying apparatus is provided which is arranged to catch and remove even further particles from the passing air, due to an additional filtering function provided by the humidification module. In some embodiments, the fluid dispensing unit comprises a wick pad or plate that is arranged to be impregnated with a humidification liquid. An air flow that passes through such an arrangement is further filtered or washed. Further, the humidifying feature may have a positive effect on the air in the room where the apparatus is operated.

In an exemplary embodiment of the air treatment apparatus, the ventilating unit comprises at least one centrifugal ventilator arranged to suck inlet air through at least one lateral inlet opening of the main housing, and to blow compressed air upwardly. Preferably, two lateral inlets are provided that are aligned with a central axis of the ventilator. Hence, also the air treatment apparatus requires only a limited installation space and base area.

In an exemplary embodiment of the air treatment apparatus, the air humidification module is arranged on top of the air purification module and supplied with upwardly flowing purified air, wherein the first flow outlet of the air humidification module is a top outlet, and wherein the second flow outlet of the air humidification module is a lateral outlet. Preferably, two lateral outlets are provided. As a consequence, a great portion of the outer surface provided by the humidification module is used for the air flow. Hence, an effective air flow cross section may be basically maintained.

In an exemplary embodiment, the air treatment apparatus further comprises a status switch that is arranged to disable an operation of the air treatment apparatus when a covering grille of the first flow outlet of the humidification module is removed.

In a further aspect of the present disclosure there is provided a method of augmenting an air treatment apparatus, the method comprising the following steps:

providing an air treatment apparatus that comprises a housing, at least one ventilating unit, at least one air purifying module, and an outlet grille that covers a flow outlet of the air treatment apparatus, providing a humidification attachment module in accordance with at least one embodiment as disclosed herein, removing the outlet grille from the housing of the air treatment apparatus, placing the humidification attachment module, in lieu of the outlet grille, at the housing, and placing the outlet grille at a first flow outlet of the humidification attachment module.

The above arrangement has the advantage that the humidification module also uses the outlet grille of the apparatus, particularly of an air purifying module thereof. Hence, no additional outlet grille is necessary. Further, when the humidification module is attached to the apparatus, no portion thereof is redundant and therefore no huge risk of losing this part is present.

In an embodiment, the placing the outlet grille actuates a status switch of the air treatment apparatus. A safety function is thus provided by the status switch of the air treatment apparatus may be maintained by extending an indicator of the outlet grille when the humidification module is placed on top of the housing of the air treatment apparatus.

Preferred embodiments of the invention are defined in the dependent claims. It shall be understood that the claimed method has similar and/or identical preferred embodiments as the claimed module and/or apparatus and as defined in the dependent claims.

BRIEF DESCRIPTION OF THE DRAWINGS

These and other aspects of the invention will be apparent from and elucidated with reference to the embodiments described hereinafter. In the following drawings

DETAILED DESCRIPTION OF THE INVENTION

Figure 1:
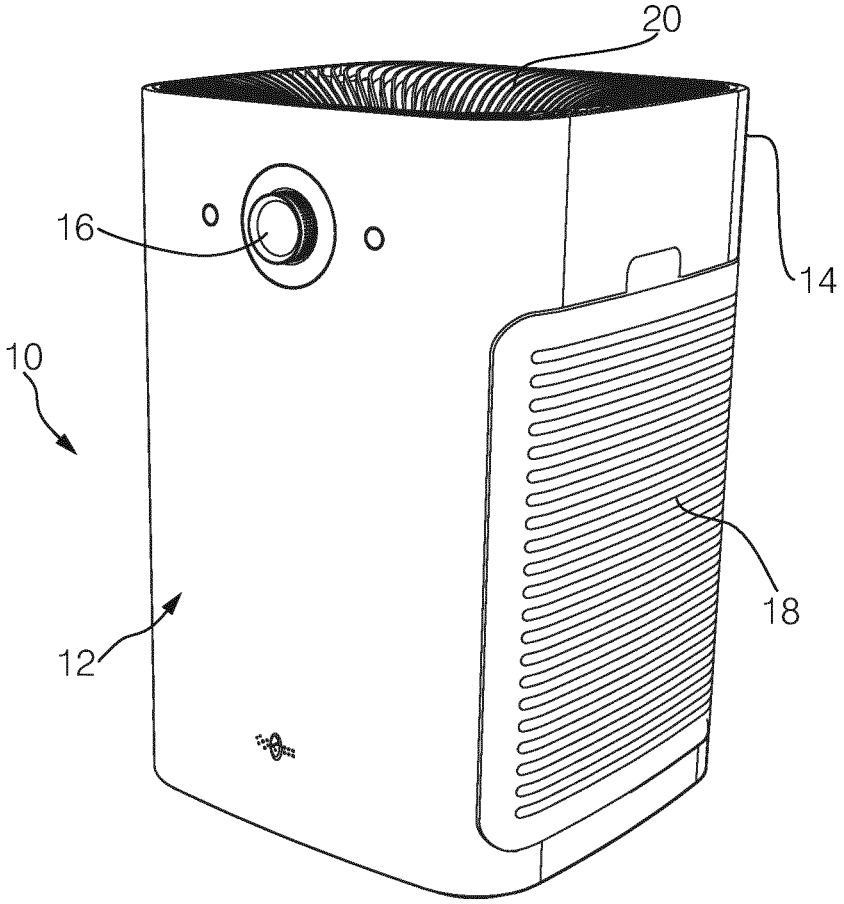
FIG. 1 shows a perspective view of an air treatment apparatus that is arranged as an air purifying apparatus.
Figure 2:
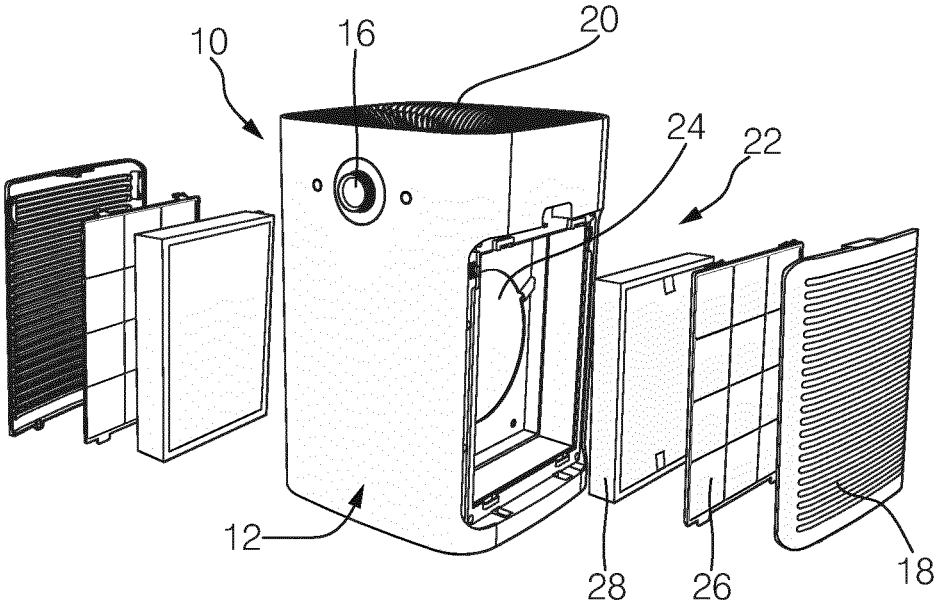
FIG. 2 shows a further perspective view of the apparatus of FIG. 1 in a partially exploded state.

FIG. 1 shows a perspective view of an air treatment apparatus that is designated by reference numeral 10. The apparatus 10 is arranged as an air purifying apparatus. FIG. 2 shows a corresponding partially exploded view of the apparatus 10, wherein the views of FIG. 1 and FIG. 2 use a similar view orientation but different scale ratios.

The apparatus 10 comprises a main housing or overall housing 12. The housing 12, at least in accordance with the embodiment shown in FIG. 1 and FIG. 2, comprises a nearly rectangular or square-shaped base area and extends upwardly. Overall, the housing 12 of the apparatus 10 defines a basically cuboid shape. Needless to say, at least slightly curved (convexly or concavely curved) walls may be present. Further, rounded and/or chamfered edges may be present.

Figure 3:
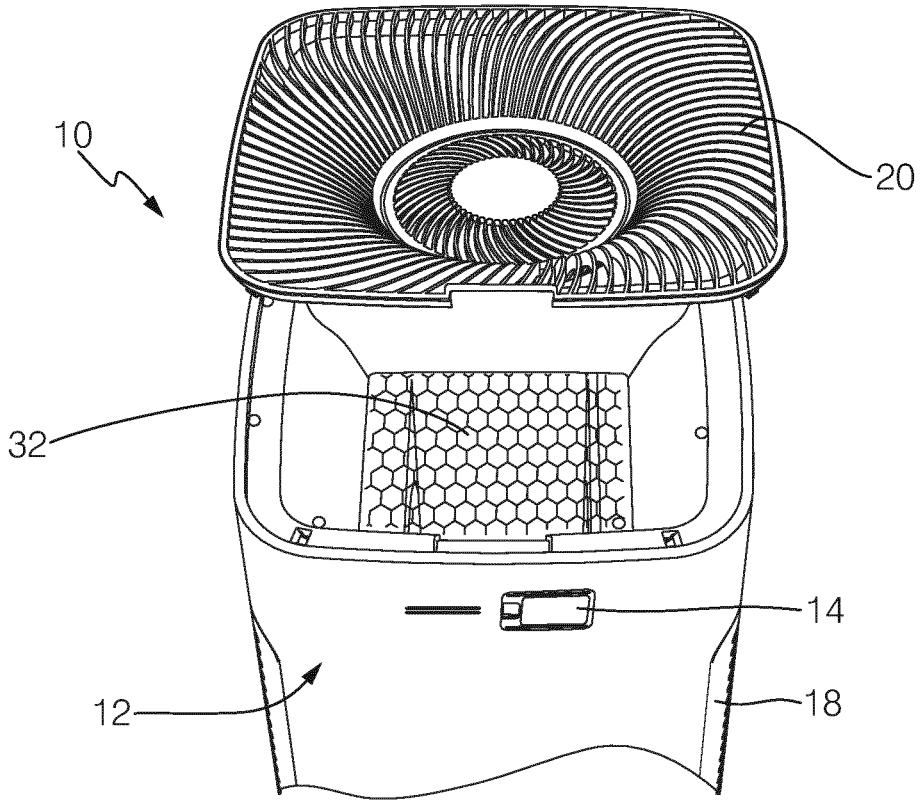
FIG. 3 shows a perspective rear end top view of the apparatus of FIG. 1 and FIG. 2, wherein an outlet cover that is arranged as a top grille is partially removed from a top end of a housing of the apparatus.

The apparatus 10 further comprises an air quality sensor unit 14, refer also to the perspective rear top view of FIG. 3. The air quality sensor unit 14 comprises at least one air quality sensor that is arranged to detect an air property. The air quality sensor unit 14 may be capable of monitoring inlet air and/or outlet air.

The apparatus 10 further comprises a user interface 16 which may comprise appropriate controls, keys, switches, indicators, LEDs, displays, etc.

In accordance with the arrangement of the exemplary embodiment illustrated in connection with FIG. 1 and FIG. 2, the apparatus 10 comprises two opposite lateral inlets that are covered by inlet covers 18 which are arranged as grilles. Further, the apparatus 10 comprises an outlet cover 20 at a top side thereof, wherein the outlet cover 20 is arranged as a grille. The outlet cover 20 may be also referred to as top grille or outlet grille.

The air purifying apparatus 10 comprises an air purification module 22 which may implement a filter arrangement. As shown in FIG. 2, a first type of filters 26 and a second type of filters 28 may be present. For instance, the filter 26 may be arranged as a pre-filter. Further, the filter 28 may be arranged as a fine-filter. The filters 26, 28 are arranged to filter an inlet air flow that enters the apparatus 10 through the inlet covers 18. Hence, an inlet air flow is a basically lateral flow. Further, an outlet air flow is a basically upwardly directed flow.

Needless to say, there may be different operating principles for air purification modules which may involve, for instance, thermodynamic sterilization, ultraviolet irradiation, photocatalytic oxidation, high-efficiency particulate arresting (HEPA) filtering, ionizer purifiers, ozone generators, and combinations thereof.

The apparatus 10 further comprises a ventilating unit which is indicated in FIG. 2 by reference numeral 24. In accordance with the exemplary embodiment of FIG. 2, the ventilating unit 24 is arranged in an interior of the housing 12 between two opposite units of inlet filters 26, 28.

FIG. 3 shows a perspective rear top view of the arrangement of FIGS. 1 and 2. The side of the housing 12 where the at least one air quality sensor of the air quality sensor unit 14 is arranged is opposite from the side of the housing 12 where the user controls 16 are arranged. However, this exemplary arrangement shall not be construed in a limiting sense.

In FIG. 3, the outlet cover 20 is shown in a detached fashion. Hence, the outlet cover 20 is removed from a top end or top edge of the housing 12. Accordingly, an inner protective cover 32 is revealed. The outlet cover 20 may be arranged to be removed without the need of tools. For instance, snap-on or snap-in mounting features may be provided which enable an attachment and a removal of the outlet cover 20.

In the state of the apparatus 10 illustrated in FIG. 3, attachment modules may be attached to the housing 12 so as to augment the apparatus 10.

Figure 4:
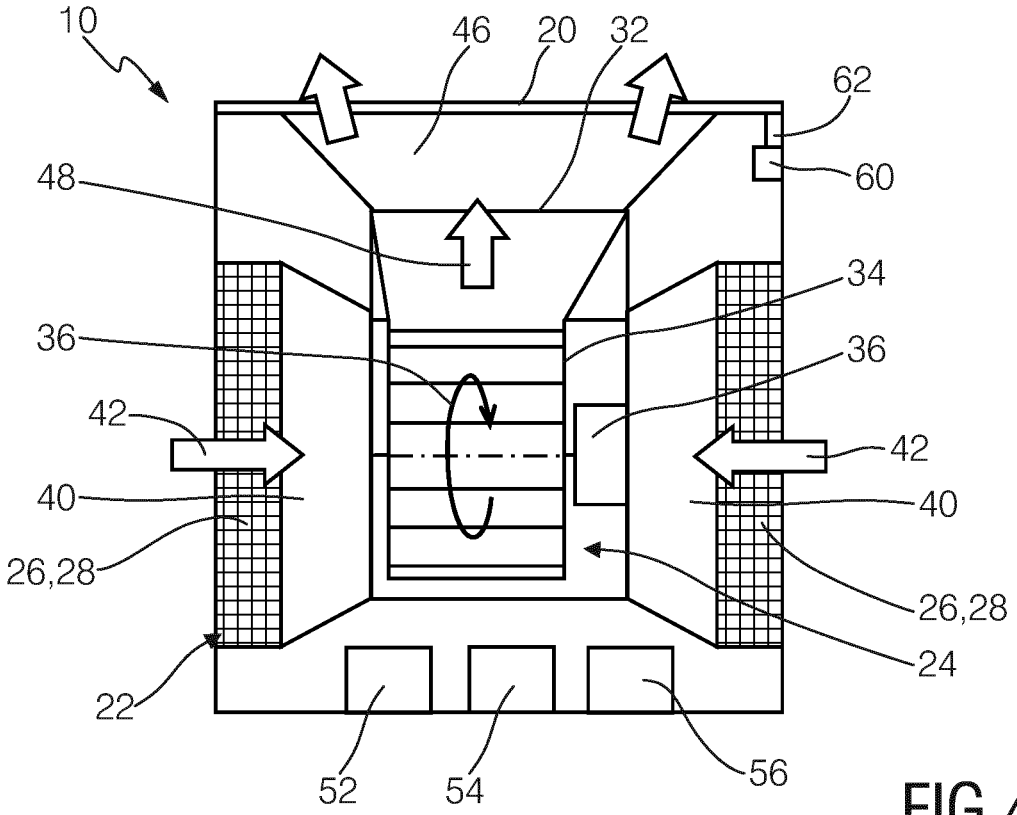
FIG. 4 shows a simplified schematic block representation of internal components of the apparatus in accordance with the arrangement of FIGS. 1 to 3.

Further reference is made to FIG. 4 showing an illustrative block diagram of components of an air treatment apparatus 10 that may be arranged in accordance with the embodiment shown in FIGS. 1, 2 and 3.

As indicated above, the apparatus 10 comprises an air purification module 22 that implements a filter arrangement that involves filters 26, 28. For instance, two opposite sets of filters 26, 28 may be provided at respective lateral ends of the housing 12 of the apparatus 10.

In a central portion of the housing 12, the ventilating unit 24 is arranged. The ventilating unit 24 comprises a ventilator 34 which is powered by a motor 36. An operation of the ventilator 34 is indicated by a curved arrow 36 in FIG. 4. By way of example, the ventilator 34 may be arranged as centrifugal ventilator. Accordingly, the ventilator 34 may be arranged to axially suck in inlet air and to blow out pressurized outlet air in a radial direction. In accordance with the arrangement of FIG. 4, the ventilator 34 is arranged to upwardly blow out pressurized air.

An inlet flow 42 passes a flow inlet 40 of the air purification module 22 and enters the ventilator 34. The inlet flow 42 passes the respective filters 26, 28.

Preferably, the inlet flow 42 comprises two inlet flow components at opposite axial sides of the ventilator 34 which are associated with the two opposite sets of filters 26, 28, as shown in FIG. 2 and FIG. 4.

At the outlet side of the ventilator 34, an outlet flow 48 escapes radially from the ventilator 34 through a flow outlet 46 of the air purification module 22 towards the top grille (outlet cover 20). The outlet flow 42 passes the inner cover 32 (refer also to FIG. 3).

Hence, ambient potentially polluted or contaminated air enters the apparatus 10 at lateral sides thereof, wherein purified airs escapes from the apparatus 10 through a top side.

The apparatus 10 further comprises a control unit 52 which is indicated in FIG. 4 by a respective control block. Further, operator controls 54 are provided. As indicated above, also a sensor unit 56 may be provided. Needless to say, the units 52, 54, 56 may be implemented in a joint control section.

The apparatus 10 further comprises a status switch 60 which may be also referred to as cover sensor. The status switch 60 is arranged to detect whether or not the outlet cover 20 is placed on top of the housing 12. For safety reasons and for functional reasons, the cover sensor 60 may disable an operation of the apparatus 10 when the outlet cover 20 is not attached to the housing 12. To this end, the outlet cover 20 may be provided with an indicator 62. The cover sensor 20 may detect a presence of the indicator 62. For instance, the cover sensor 60 may be arranged as a Reed switch. Then, the indicator 62 may involve a permanent magnet. The presence of the permanent magnet of the indicator 62 actuates the cover sensor 60. Hence, when the outlet cover 20 is put into place, the apparatus 10 may be enabled and set into operation. Other types of contactless and contact status switches may be envisaged.

Figure 5:
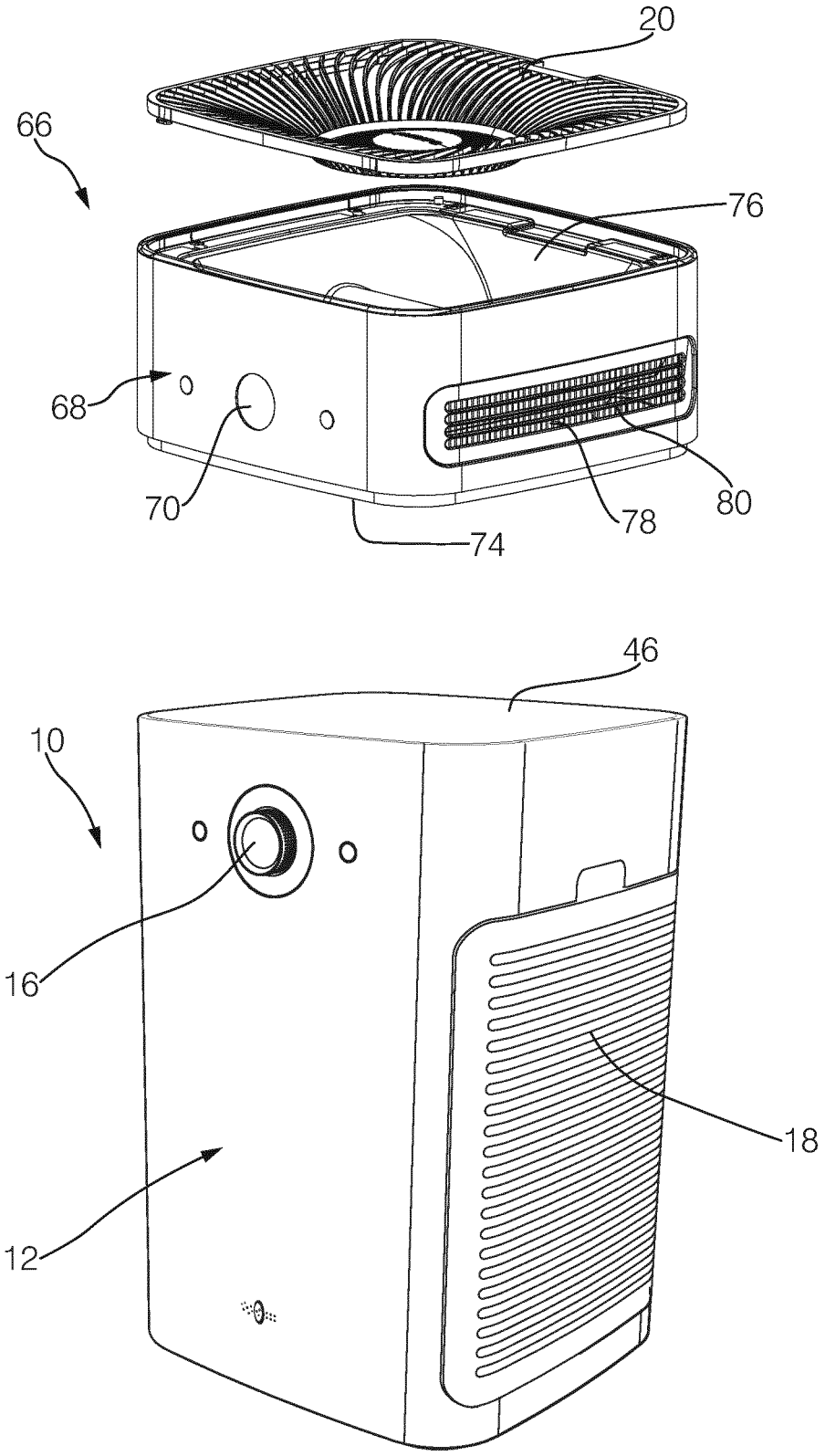
FIG. 5 shows a further perspective view of the apparatus in accordance with FIGS. 1 and 2, wherein a humidification module is provided which is arranged as an attachment module and shown in a detached state.
Figure 6:
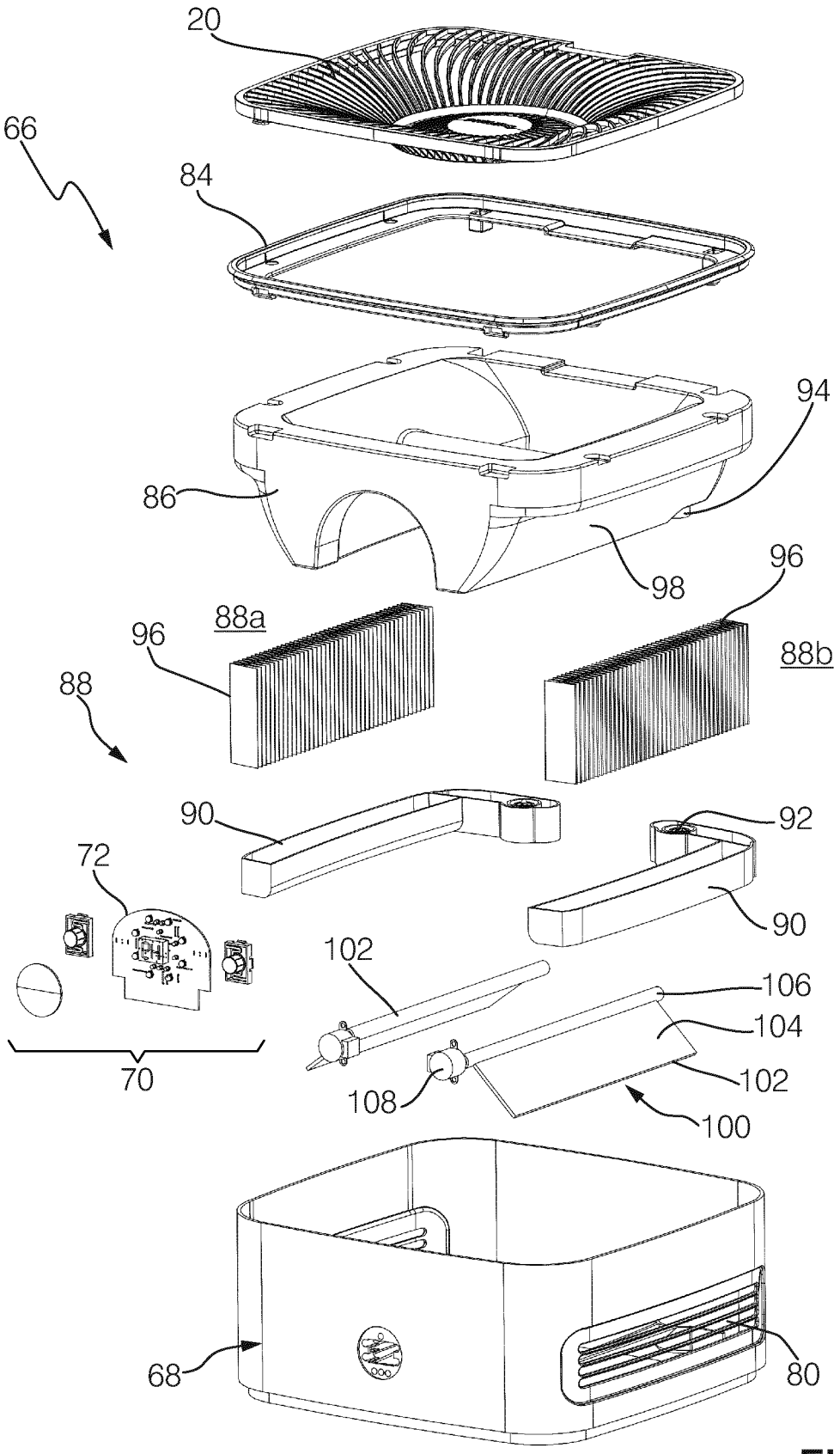
FIG. 6 shows an exploded perspective view of the humidification module of the arrangement of FIG. 5.
Figure 7:
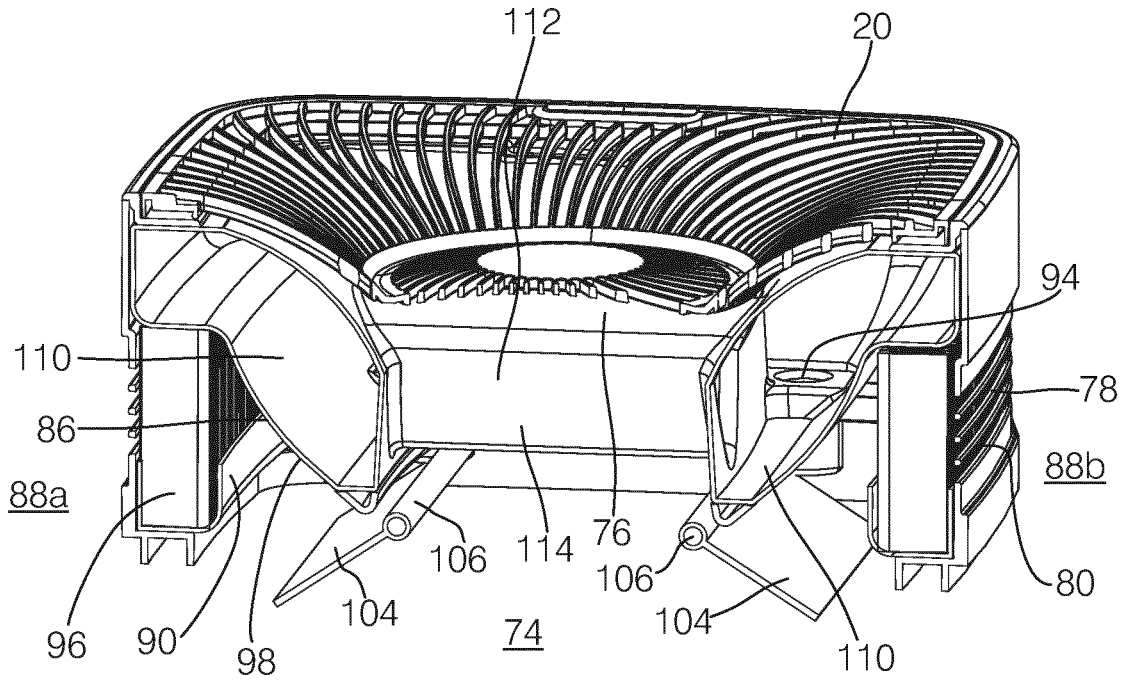
FIG. 7 shows a cross-sectional perspective view of the humidification module of FIGS. 5 and 6.

With reference to FIG. 5, FIG. 6 and FIG. 7, an augmented state of the apparatus 10 is illustrated and will be further described. In FIG. 5, the outlet cover 20 is removed from the top end of the housing 12 of the apparatus 10. In this state, a humidification module 66 may be coupled with the apparatus 10. The humidification module 66 may be also referred to as attachment module. The module 66 may be placed on top of the housing 12. The outlet cover 20 which initially was placed on top of the housing 12 may be placed in the augmented state of the apparatus 10 at a top end of the module 66.

A main purpose of the humidification module 66 is to humidify outlet air of the air purification module 22. This may have a further positive impact on the air purifying function of the apparatus 10. Further, air humidification may further condition the air in a room where the apparatus 10 is operated.

As can be best seen in FIG. 5, the module 66 may be arranged as an accessory module which involves that already existing air treatment apparatuses 10 may be upgraded accordingly. Further, in the event that no air humidification is required, the module 66 may be removed from the apparatus 10.

The module 66 comprises a housing portion 68 which is adapted to be attached to the overall housing 12 of the apparatus 10. Preferably, the module 66 is arranged to be attached to the housing 12 in a releasable fashion, particularly a snap-on or click-on fashion, without the need of installation tools.

As can be further seen from FIG. 5, a base area of the housing portion 68 basically corresponds to a base area of the housing 12. Consequently, also the augmented apparatus 10 that is equipped with the module 66 is arranged in an integrally shaped fashion or unibody fashion.

The module 66 may further comprise user controls 70 so as to control the operation thereof. User controls 70 may involve user interface elements, such as buttons, switches, keys, indicators, LED, displays, etc. Further, a control unit 72 may be provided for controlling the operation of the module 66, particularly for controlling an air flow through the module 66.

A flow inlet of the attachment module 66 is indicated by reference numeral 74. The flow inlet 74 basically matches and covers the flow outlet 46 of the basic arrangement of the apparatus 10. Consequently, purified air that escapes from the housing 12 enters the housing portion 68 of the module 66.

The module 66 further comprises a first flow outlet 76 and at least one second flow outlet 78. The first flow outlet 76 may be also referred to as dry air flow outlet. The second flow outlet 78 may be also referred to as humidified air flow outlet.

As can be best seen in FIG. 6 and FIG. 7, two opposite second flow outlets 78 may be present that are covered by respective side covers 80 which may be also referred to as side grilles. The first flow outlet 76 is covered by the outlet cover 20 which may be also referred to as top grille.

It is beneficial to provide the attachment module 66 with both the first flow outlet 76 and at least one second flow outlet 78. Hence, a user may choose whether the purified air that is supplied by the air treatment apparatus 10 shall be, in addition to the purifying feature, humidified or not. Further, a degree of humidification may be controlled by the user by controlling the air flow through the first flow outlet 76 and the second flow outlet 78 as will be further discussed hereinafter.

With particular reference to FIG. 6 and FIG. 7, the structure of the exemplary embodiment of the module 66 illustrated herein will be further described. The module 66 comprises a receiving frame 84 which is arranged to receive the outlet cover 20. Further, the module 66 comprises a fluid reservoir 86 which is operatively coupled with a fluid dispensing unit 88. The fluid dispensing unit 88 comprises a tray 90. The tray 90 comprises a connector 92. At the fluid reservoir 86 a stud 94 is provided. The connector 92 and the stud 94 may be coupled with one another in such a way that the fluid dispensing unit 88, particularly the tray 90 thereof, may be selectively supplied with fluid (typically water) from the fluid reservoir 86.

In the tray 90, fluid absorbing material 96 is provided which is typically arranged as a block or pad. The fluid absorbing material 96 may be also referred to as wick or wick pad.

Preferably, the fluid dispensing unit 88 comprises two opposite sections 88*a*, 88*b* which are arranged in the vicinity of opposite lateral sides of the housing 68. An advantage of this arrangement is that the fluid flow through the module 66 which may involve a dry flow component and a humidified flow component is not considerably obstructed by the provision of the fluid dispensing unit 88. Hence, even though there are structural constraints involving a limited installation space, there is a sufficient cross-sectional flow area for both the dry flow and the humidified flow. Further, an overall outlet flow of the module 66 may involve, at the same time, a dry flow component and a humidified flow component. This allows for a fine adjustment of the degree of humidification.

At the fluid reservoir 86, guiding surfaces 98 are formed that facilitate an air flow towards and through the fluid absorbing material 96 so as to humidify the air flow passing therethrough. Hence, an upwardly directed air flow is laterally deflected by the guiding surfaces 98 and basically laterally guided towards the fluid absorbing material 96.

The passing air flow may entrain the fluid (typically water) when passing through the wick material that is arranged in the tray 90.

As indicated above, two pads of fluid absorbing material 96 and two corresponding trays 90 may be present. The trays 90 are operatively coupled with the fluid reservoir 86 in such a way that a defined fluid supply rate is provided. The fluid that is supplied to the trays 90 from the fluid reservoir 86 is absorbed by the absorbing material 96 and gradually transferred to the passing air flow which is humidified in this way.

So as to control a ratio of humidified and non-humidified air, a flow dividing unit 100 is provided. The flow dividing unit 100 comprises a flow diverter 102. Preferably, two flow diverters 102 are provided which may be arranged in an opposite fashion. In the embodiment illustrated with reference to FIG. 6 and FIG. 7, the flow diverters 102 comprise louvers 104 which are arranged to be pivoted about an axis 106. To this end a motor 108 is provided which may be arranged as a step-motor. Consequently, a swivel orientation of the louvers 104 may be defined and adjusted. Each of the flow diverters 102 is associated with a respective one of the sections 88*a*, 88*b* of the fluid dispensing unit 88. Depending on an actual swivel state of the flow diverters 102 of the flow dividing unit 100, a ratio of a humidified flow and a dry flow of the overall outlet flow may be controlled. Hence, an overall degree of humidification may be controlled.

Via the control 70, the user may set a desired ratio of humidified air and dry air. Depending on the desired ratio, the motors 108 may be operated by the control unit 72 to move the louvers 104 into the required swivel state.

The fluid reservoir 86 comprises a fluid compartment 110 that encloses and defines a central opening 114. The opening 114 defined by the fluid compartment 110 may be referred to as dry flow opening 114. The opening 114 is associated with the first flow outlet 76.

In the exemplary embodiment illustrated in FIG. 6 and FIG. 7, a central connector 112 is arranged in the opening 114. The central connector 112 connects respective portions of the fluid compartment 110 that are respectively associated with the sections 80*a*, 80*b* of the fluid dispensing unit 88. The central connector 112 may be used as a handle when the fluid reservoir 86 is removed from the module 66 for refilling.

As indicated above, the fluid reservoir 86, particularly the two opposite sections of the fluid compartment 110 thereof, is/are provided with the guiding surfaces 98 which are inclined with respect to a vertical direction (perpendicular to a main extension of the outlet cover) and to a lateral direction (perpendicular to a main extension of the side covers 80).

Hence, an airflow that is basically upwardly directed and that contacts the guiding surfaces 98 is deflected towards the side covers 80 and may pass the wick pads made from the absorbing material 96.

By controlling the swivel state of the flow diverters 102 of the flow dividing unit 100, the user may obstruct an air flow to the first flow outlet 76 or the second flow outlets 78. The two flow diverters 102 of the exemplary embodiment discussed herein are associated with a respective section of the fluid compartment 110 of the fluid reservoir 86. In a first swivel state, an air flow through the opening 114 is permitted, while an air flow towards the second flow outlets 78 is inhibited. In a second swivel state, an air flow through the opening 114 towards the first flow outlet 76 is inhibited, while an air flow towards the second flow outlets 78 is permitted. Needless to say, intermediate swivel states may be present wherein both flow components may form part of the overall flow. Further, the first and the second swivel state do not necessarily involve a perfect blocking of the respectively inhibited flow component.

Figure 8:
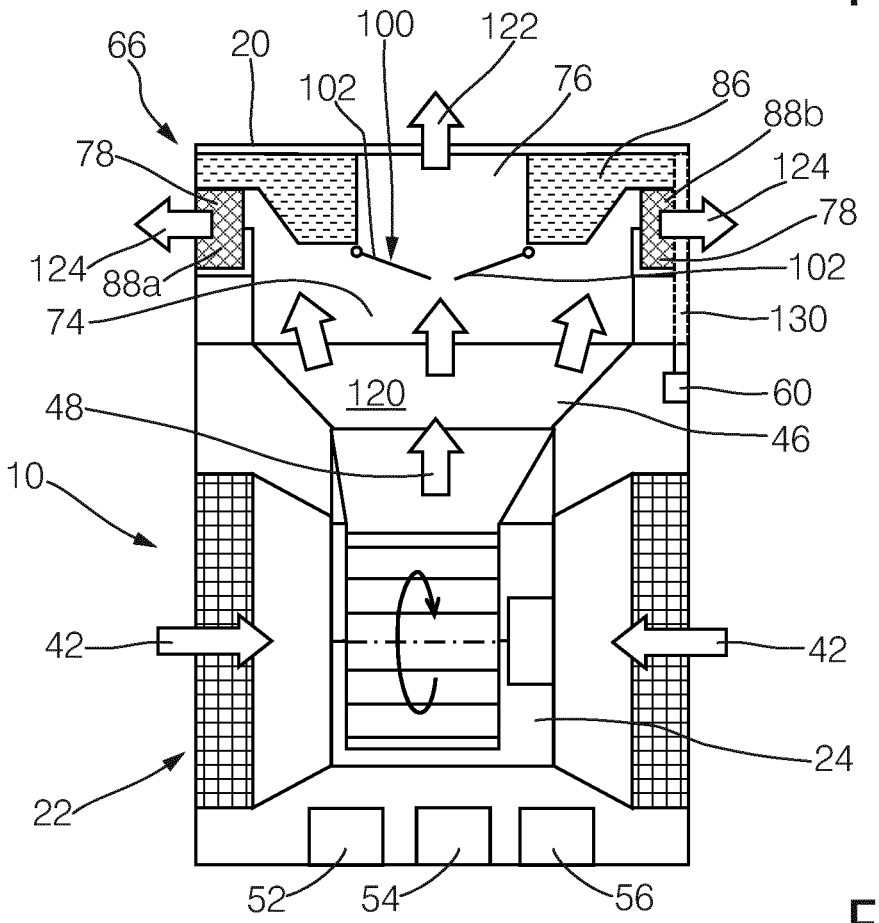
FIG. 8 is a simplified schematic view of an augmented air treatment apparatus that is basically arranged in accordance with the apparatus of FIG. 4, but that is fitted with a humidification module.
Figure 9:
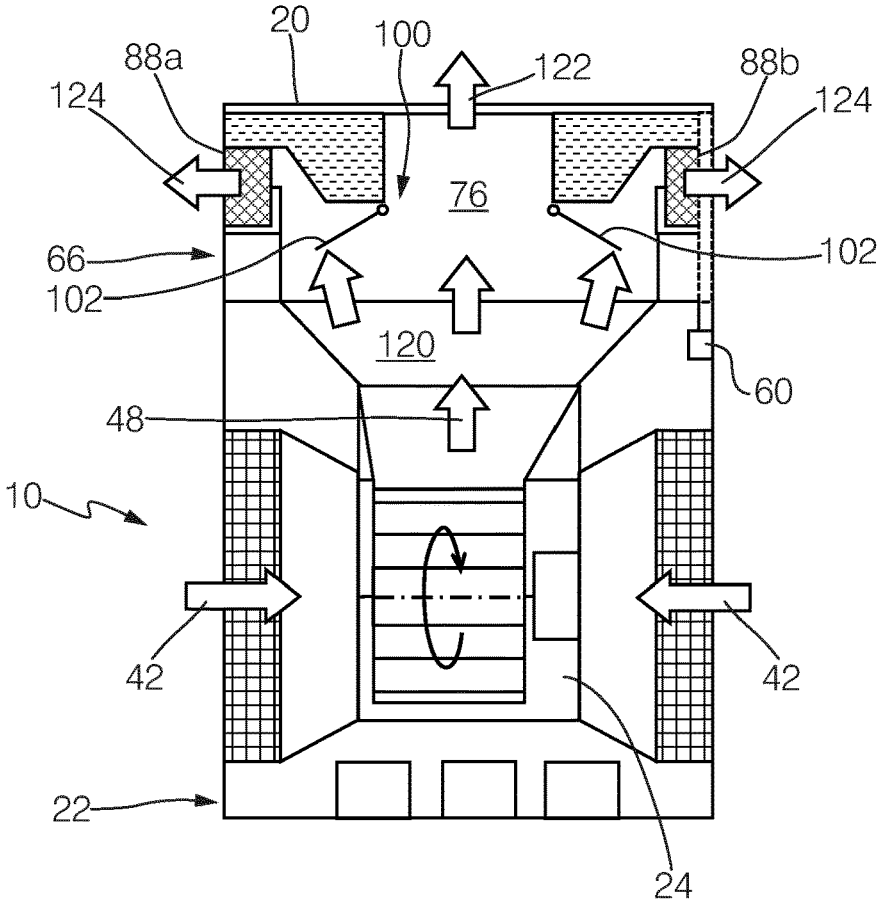
FIG. 9 shows a further simplified schematic view of the augmented air treatment apparatus of FIG. 8, wherein the humidification module is shown in FIG. 8 and FIG. 9 in different states of operation.

Further reference is made to the simplified schematic illustrations of FIG. 8 and FIG. 9 which are based on the illustration of the apparatus 10 of FIG. 4. In FIG. 8 and FIG. 9, the apparatus 10 is equipped with the humidification module 66.

Consequently, an outlet flow 48 of the air purification module 22 may be divided by the flow dividing unit 100 into a first flow component and a second flow component.

In other words, the outlet flow 48 of air escaping through the flow outlet 46 of the air purification module 22 enters the humidification module 66 through the flow inlet 74. Hence, the outlet flow 48 defines an overall inlet flow 120 of the humidification module 66.

Depending on an actual state of the flow dividing unit 100, the input flow 120 is divided into a first outlet flow 122 and a second outlet flow 124. The first outlet flow 122 escapes from the module 66 via the first flow outlet 76. The second outlet flow 124 escapes from the module 66 via the second flow outlet 78 which involves that the second outlet flow passes the fluid dispensing unit 88 and entrains a fraction of the fluid that is provided by the absorbing material 96. In other words, the first outlet flow 122 may be referred to as dry outlet flow. The second outlet flow 124 may be referred to as humidified or moist outlet flow.

As can be seen from FIG. 8 and FIG. 9, the flow diverters 102 of the flow dividing unit 100 are arranged as shutters that may block or release a respective flow. In the second state of operation as illustrated in FIG. 8, the flow diverters 102 may considerably block the first flow outlet 76. In the first state of operation as illustrated in FIG. 9, the flow diverters 102 may considerably block the second flow outlets 78. Hence, a share of the first outlet flow 122 and the second outlet flow 124 may be finely graduated and adjusted.

The capacity of the fluid reservoir 86 ensures a defined minimum operation time of the module 66. A fill level sensor may be provided in the fluid reservoir 86 which indicates when a refill operation is required.

As already explained hereinbefore in connection with FIG. 4, the apparatus 10 comprises a cover sensor 60 that serves as a status switch. So as to maintain the function of the cover sensor 60, the module 66 comprises an indicator extension 130 which couples an indicator provided by the outlet cover 20 and the cover sensor 60 in a state when the module 66 is arranged therebetween. Hence, operational safety enhancing features may be maintained, even when the apparatus 10 is augmented by the humidification module 66.

Figure 10:
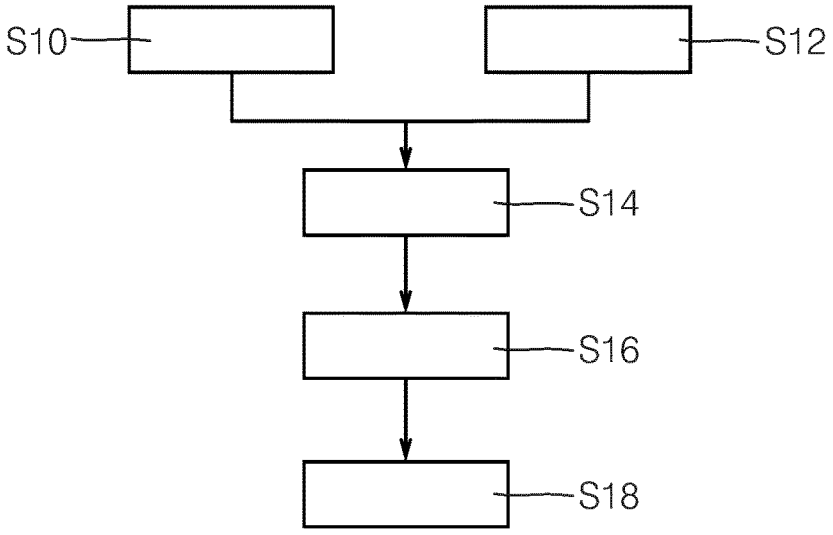
FIG. 10 is a schematic block diagram illustrating an exemplary embodiment of a method of augmenting an air treatment apparatus in accordance with the present disclosure.

Reference is made to FIG. 10 illustrating an exemplary block diagram that represents an exemplary embodiment of a method of augmenting an air treatment apparatus. The method involves a step S10 which involves a provision of an air treatment apparatus, particularly an air purifying apparatus. The apparatus is not necessarily equipped with an integrated air humidification module. Rather, the air treatment apparatus is primarily equipped with an air purification module. The method further comprises a step S12 which involves a provision of an attachment module that is arranged as a humidification module. Preferably, the module comprises a fluid dispensing unit which is arranged to humidify passing air. Preferably, the module provides a first flow path and a second flow path, wherein the first flow path is a dry flow path, where no humidification takes place, and wherein the second flow path is a humidification flow path.

Several steps S14 to S18 are required so as to couple the humidification module with the apparatus S10. In a step S14, an outlet grille of the air treatment apparatus is removed from a housing thereof. Typically, the outlet grille covers a flow outlet of the air purification module. In a further step S16, when the outlet grille is removed, the humidification attachment module, in lieu of the outlet grille, is placed at the housing. This may involve a placement of the humidification module on top of the housing of the apparatus.

In a further step S18, the outlet grille is placed on a flow outlet of the humidification module. Hence, the outlet grille maintains its function, even though the apparatus is augmented by the humidification module. Preferably, the humidification module is arranged in such a way that an attachment of the outlet grille actuates a status switch of the air treatment apparatus that is arranged, in a non-augmented state of the apparatus, to detect the presence of the outlet grille. Consequently, the detection feature provided by the status switch may be maintained.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. An air treatment apparatus comprising:
a ventilating unit comprising:
a motor; and
a ventilator, said ventilating unit configured to:
generate an airflow through said air treatment apparatus;
an air purification module comprising:
at least one filter, said air purification module configured to:
purify air within said airflow;
a main housing comprising:
a housing flow outlet, wherein said purified air within said airflow passes through said housing flow outlet;
a humidification attachment module comprising:
an air flow inlet configured to:
receive said purified air from said housing flow outlet; and
a housing portion comprising:
a first flow outlet, wherein said purified air exits said air treatment apparatus; and
an outlet grille configured to:
cover one of: said housing flow outlet and said first flow outlet, wherein the humidification attachment module and the outlet grille can interchangeably cover said housing flow outlet, wherein said air treatment apparatus is configured to:
adopt one of:
an augmented configuration, wherein the humidification attachment module covers the housing flow outlet and said outlet grille covers the first flow outlet, and
a non-augmented configuration, wherein the outlet grille covers the housing flow outlet.

2. The air treatment apparatus as claimed in claim 1, wherein the humidification attachment module comprises:
a fluid dispensing unit comprising:
a fluid reservoir configured to:
store a humidification fluid; and
a fluid dispenser configured to:
dispense said humidification fluid stored within said fluid reservoir,
a first flow path defined between the air flow inlet and the first flow outlet, wherein said first flow path is configured to bypass said fluid dispenser;
a second flow path defined between the air flow inlet and a second flow outlet, wherein said second flow path is configured to pass through said fluid dispenser; and
a flow divider,
wherein the flow divider is configured to:
divide said airflow through the humidification attachment module into at least one of: a first flow path component and a second flow path component.

3. The air treatment apparatus as claimed in claim 2, wherein the fluid dispensing unit comprises:
absorbing material arranged for storing said humidification fluid.

4. The air treatment apparatus as claimed in claim 3, wherein the absorbing material comprises:
a wick material arranged in at least one wick pad, said wick material impregnated with the humidification fluid, wherein the wick material is associated with the second flow outlet.

5. The air treatment apparatus as claimed in claim 2, wherein the fluid dispensing unit comprises:
at least two sections spaced away from one another, wherein the first flow path is led through an intermediate passage space between the at least two sections of the fluid dispensing unit toward the first flow outlet.

6. The air treatment apparatus as claimed in claim 2, wherein the flow divider comprises:
at least one adjustable flow diverter configured to:
adjust a ratio between the first flow path component and the second flow path component.

7. The air treatment apparatus as claimed in claim 6, wherein the at least one adjustable flow diverter comprises:
a movable louver, wherein the movable louver is configured to:
pivot about a swivel axis.

8. The air treatment apparatus as claimed in claim 7, movable louver comprises:
wherein a pair of opposite louvers, each of which is associated with a section of the fluid dispensing unit, wherein said pair of opposite louvers inhibit the first flow path component in a second swivel state, and inhibit a second flow path component in a first swivel state.

9. The air treatment apparatus as claimed in claim 2, wherein the fluid reservoir comprises:
a water compartment that defines a bypass opening for the first flow path component, and wherein the fluid reservoir comprising guiding surfaces for guiding the second flow path component towards the second flow outlet.

10. The air treatment apparatus as claimed in claim 2, wherein the humidification attachment module is arranged on top of the air purification module and the first flow outlet of the air humidification module is a top outlet, and wherein the second flow outlet of the air humidification attachment module is a lateral outlet.

11. The air treatment apparatus as claimed in claim 1, wherein the humidification attachment module further comprises:
an indicator extension configured to:
operate as a status switch on said main housing when the humidification attachment module is attached thereto, said status switch configured to:

disable an operation of the humidification attachment module when the outlet grille is removed.

12. The air treatment apparatus as claimed in claim 1, wherein the humidification attachment module is configured to:

attach to the air treatment apparatus in a snap-on mounting fashion.

13. The air treatment apparatus as claimed in claim 1, wherein the ventilator comprises:

at least one centrifugal ventilator, driven by said motor, configured to:

suck said air through at least one lateral inlet opening of said main housing, and blow said air upwardly toward said housing flow outlet.

* * * * *